US008604376B2

(12) United States Patent
Kong et al.

(10) Patent No.: US 8,604,376 B2
(45) Date of Patent: Dec. 10, 2013

(54) ELECTRICAL SWITCH

(75) Inventors: Ming Leong Kong, Hong Kong (CN); Man Chi Li, Hong Kong (CN)

(73) Assignee: Defond Components Limited, Hong Kong SAR (CN)

( * ) Notice: Subject to any disclaimer, the term of this patent is extended or adjusted under 35 U.S.C. 154(b) by 24 days.

(21) Appl. No.: 13/370,518

(22) Filed: Feb. 10, 2012

(65) Prior Publication Data

US 2013/0206561 A1 Aug. 15, 2013

(51) Int. Cl.
*H01H 21/24* (2006.01)

(52) U.S. Cl.
USPC ..... 200/557

(58) Field of Classification Search
USPC ..... 200/339, 341, 523, 538, 557
See application file for complete search history.

(56) References Cited

U.S. PATENT DOCUMENTS 3,312,801 A 4/1967 Schleicher
4,789,766 A * 12/1988 Krause ..... 200/302.3
4,978,823 A * 12/1990 Sato et al. ..... 200/437
5,504,286 A * 4/1996 Tsai ..... 200/5 R
5,950,812 A * 9/1999 Tanacan et al. ..... 200/458
5,981,885 A 11/1999 Katoh et al.
6,479,776 B2 * 11/2002 Nakase et al. ..... 200/559
6,633,013 B2 * 10/2003 Nishimura et al. ..... 200/559

FOREIGN PATENT DOCUMENTS

DE 42 18 535 C1 9/1993
EP 0 920 037 A2 6/1999

OTHER PUBLICATIONS

European Patent Office; Extended European Search Report in European Patent Application No. 13 15 4344 (Jun. 3, 2013).

* cited by examiner

*Primary Examiner* — Vanessa Girardi
(74) *Attorney, Agent, or Firm* — Leydig, Voit & Mayer, Ltd.

(57) ABSTRACT

An electrical switch has a fixed contact and a moving contact moving between a first position in contact with the fixed contact and a second position not in contact with the fixed contact. An operating mechanism moves the moving contact and includes a resiliently biased presser resiliently pressing upon the moving contact while riding in opposite first and second directions past a barrier associated with the moving contact, and a spring having first and second parts acting on first and second sides of the presser to maintain the presser in a neutral position and providing extra biasing force to assist the presser in moving faster upon riding past the barrier.

21 Claims, 8 Drawing Sheets

ELECTRICAL SWITCH

The present invention relates to an electrical switch or electrical switch assembly for controlling the operation of an electrical appliance.

BACKGROUND OF THE INVENTION

Electrical switches especially those for controlling the operation of power tools are designed with care and precision and must meet a variety of official standards and requirements on, inter alia, performance, safety and durability.

Electrical circuits of various kinds are susceptible to a number of unfavorable conditions. For example, in an ON/OFF switch, arcing or sparking may occur between electrical contacts when such paired contacts bounce or partially separate upon toggling the switch to the OFF position, generally known as a teasable condition in an electrical system. Furthermore, the contacts of such an electrical system may weld together causing the circuit to remain closed even after the switch has been in the OFF position for a number of cycles.

The invention seeks to provide a new or otherwise improved electrical switch that is relatively more durable and yet remains functional viable and safe.

SUMMARY OF THE INVENTION

According to the invention, there is provided an electrical switch comprising a body and at least one fixed contact and a moving contact supported by the body and arranged for movement between a first (ON) position in contact with said at least one fixed contact and a second (OFF) position out of contact with said at least one fixed contact. Included is an operating mechanism for operating the moving contact by moving the moving contact between the first and second positions. The operating mechanism includes a resiliently biased presser resiliently pressing upon the moving contact for moving the moving contact between the first and second positions while riding in opposite first or second direction past a barrier associated with the moving contact. The presser has opposite first and second sides corresponding to the first and second directions. The operating mechanism includes a spring having first and second parts acting on the first and second sides of the presser respectively to maintain the presser in a neutral position yet permitting limited extra movement of the presser in a rearward direction against the action of the spring as the presser reaches the barrier in a forward direction, thereby accumulating extra forward biasing force in the spring upon the presser to assist the presser to move relatively faster upon riding past the barrier.

Preferably, each of the first and second parts of the spring includes at least one bend about which the first or second part exhibits spring action.

More preferably, each of the first and second parts of the spring is of an elbow configuration.

In a preferred embodiment, the first and second parts are integral parts of the spring.

More preferably, the spring includes an intermediate part having opposite ends, with one end integral with the first part and the other end integral with the second part.

Further more preferably, the intermediate part of the spring extends substantially across the opposite sides of the presser.

Yet further more preferably, the presser has an inner surface on which the intermediate part of the spring extends.

Yet further more preferably, the inner surface of the presser has a groove extending substantially across the opposite sides of the presser, and the intermediate part of the spring is located in and along the groove.

It is preferred that the presser has a recess, and the spring is located with its intermediate part within the recess.

It is preferred that the presser has a U-shaped cross-section, and the spring is located with its intermediate part within the U-shaped cross-section.

It is further preferred that the presser is of a U-shape having an inner side, and the spring is located with its intermediate part within the inner side.

In a specific construction, the spring is provided by a wire bent to form at least the first and second parts.

In a specific construction, the spring has a generally M-shaped configuration whose middle turn is of a rectangular U-shape.

Advantageously, the presser is also resiliently biased by the spring to press upon the moving contact.

In a preferred arrangement, the presser is held partially within a carrier, the carrier having an outwardly-inclined surface against which the spring acts to also resilient bias the presser to press upon the moving contact.

In a preferred embodiment, the presser is resiliently biased by a second spring to press upon the moving contact.

More preferably, the second spring comprises a compression coil spring acting behind the presser.

It is preferred that the operating mechanism includes a carrier in engagement with and carrying the presser, with the spring or springs being located and co-acting between the presser and the carrier.

It is further preferred that the presser extends beyond the carrier in an axial direction pressing upon the moving contact, and the carrier holds the presser for limited sliding movement in the axial direction and for the aforesaid limited extra movement substantially at right angles to the axial direction.

It is further preferred that the carrier and the presser have co-operable latching elements which latch the carrier and the presser together upon engagement.

It is further preferred that the carrier has a cavity partially within which the presser with the spring or springs is held, the cavity having an opening through which the presser protrudes out in the axial direction.

In a specific embodiment, the operating mechanism includes a trigger for manual operation to move the presser and in turn the moving contact between the first and second positions.

BRIEF DESCRIPTION OF DRAWINGS

The invention will now be more particularly described, by way of example only, with reference to the accompanying drawings, in which.

DETAILED DESCRIPTION OF PREFERRED EMBODIMENT

Figure 1:
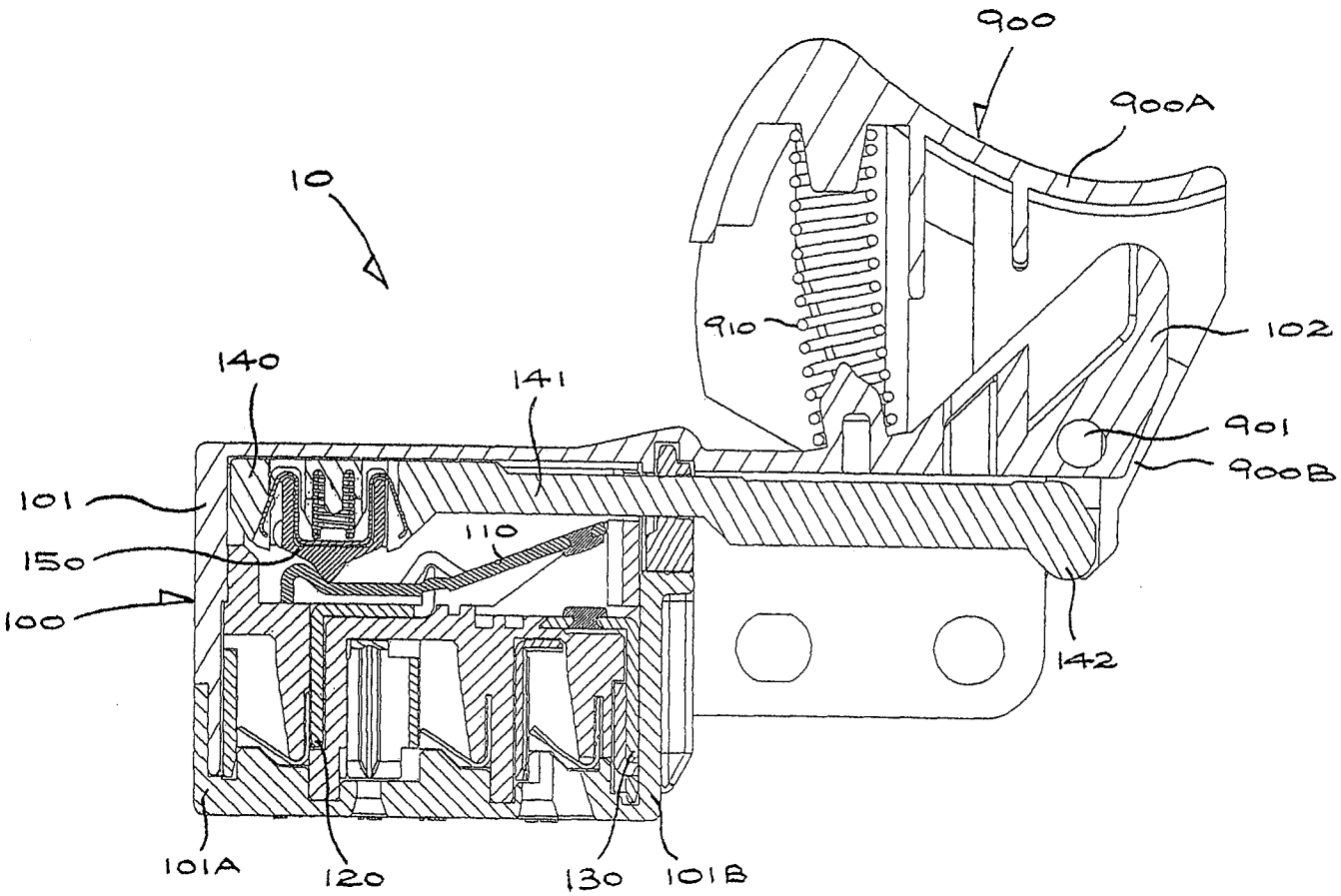
FIG. 1 is a cross-sectional side view of an embodiment of an electrical switch in accordance with the invention.
Figure 2:
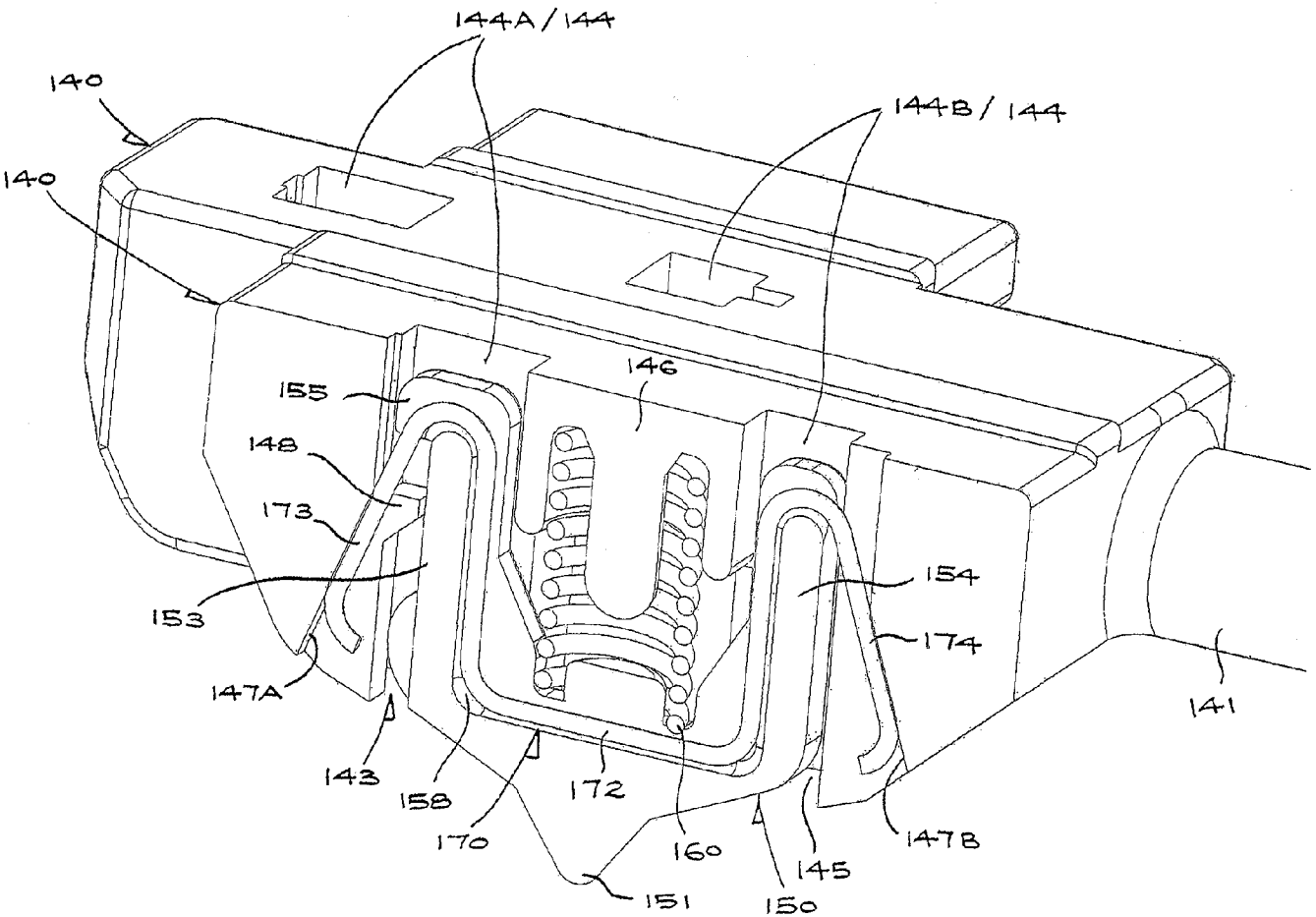
FIG. 2 is a partially cut-out perspective view, on an enlarged scale, of an operating part of the electrical switch of FIG. 1.
Figure 3:
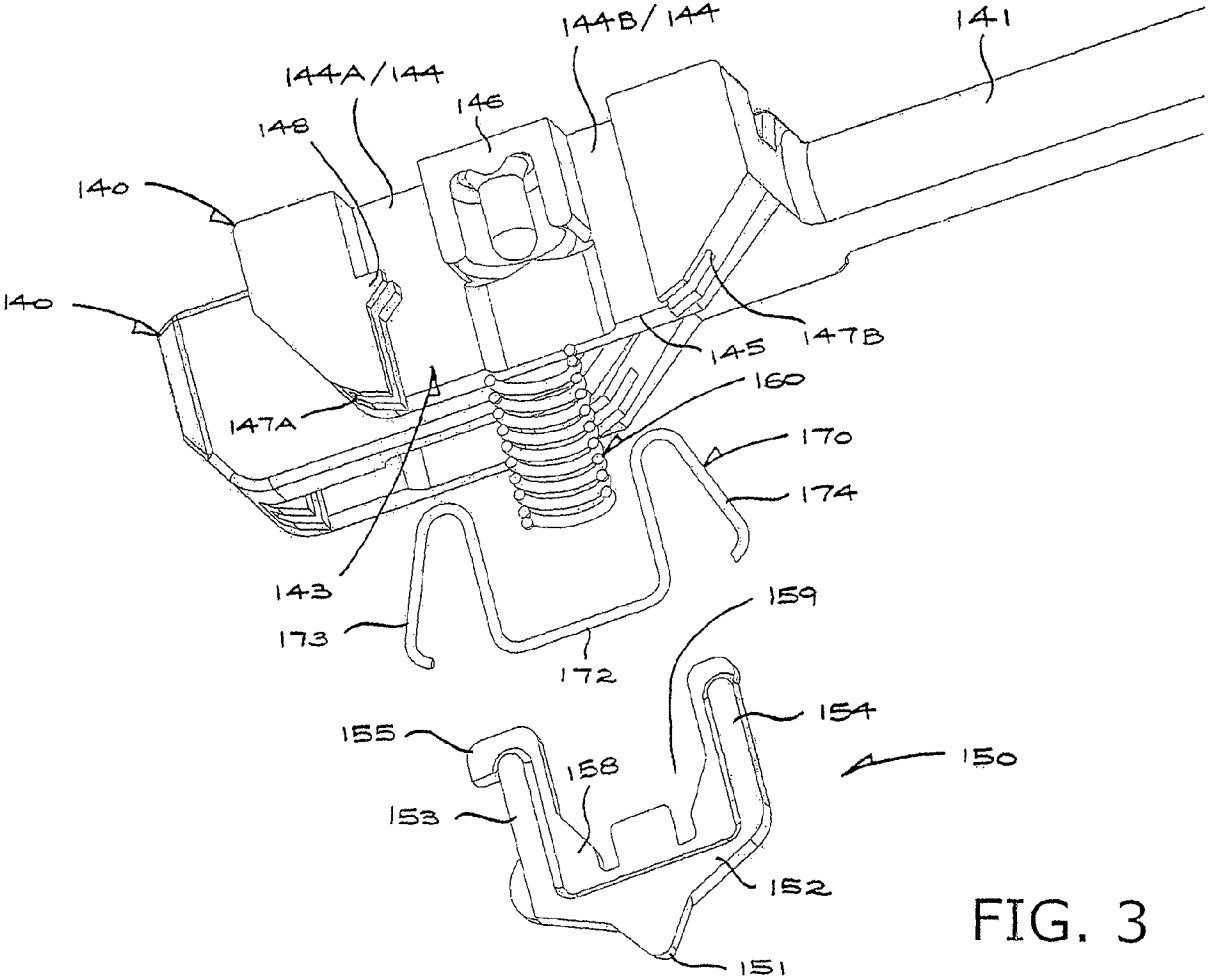
FIG. 3 is an exploded perspective view of the operating part of the electrical switch of FIG. 2.
Figure 4:
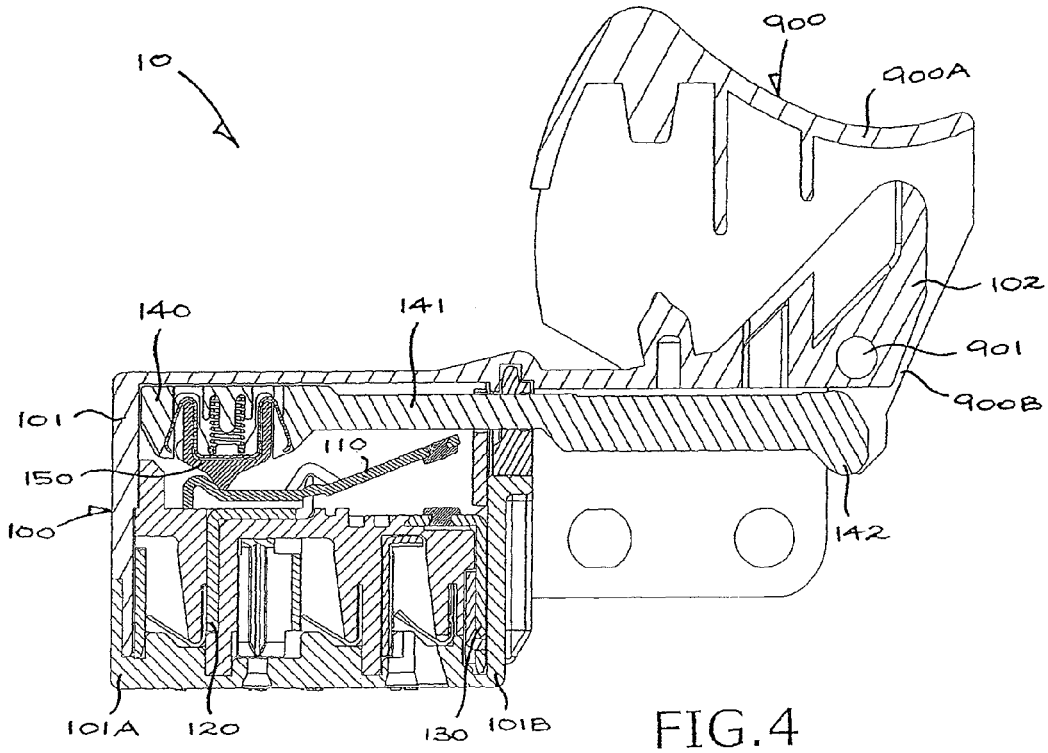
FIGS. 4 and 4A are perspective views of the electrical switch of FIG. 1, showing the switch in an OFF position.
Figure 4A:
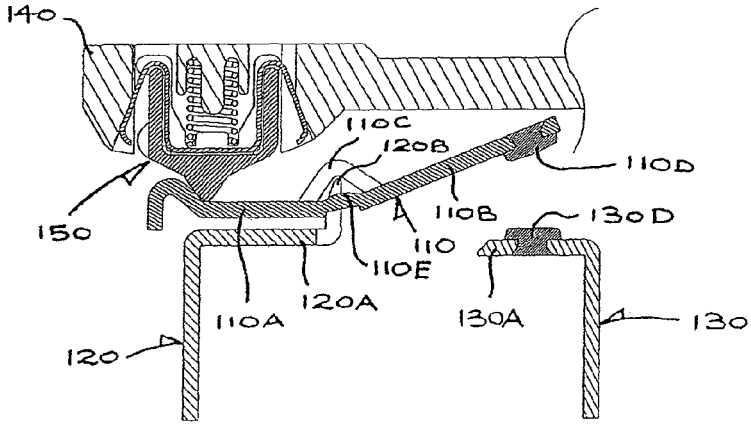
Figure 5:
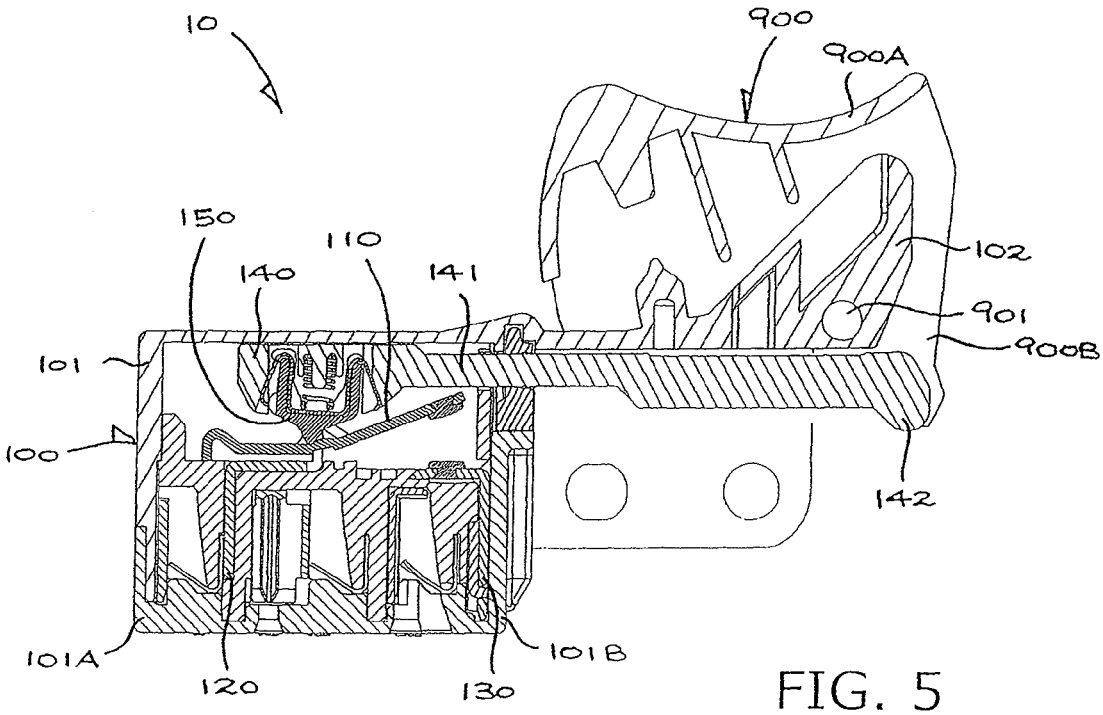
FIGS. 5 and 5A are perspective views corresponding to FIGS. 4 and 4A, showing the electrical switch in a later condition.
Figure 5A:
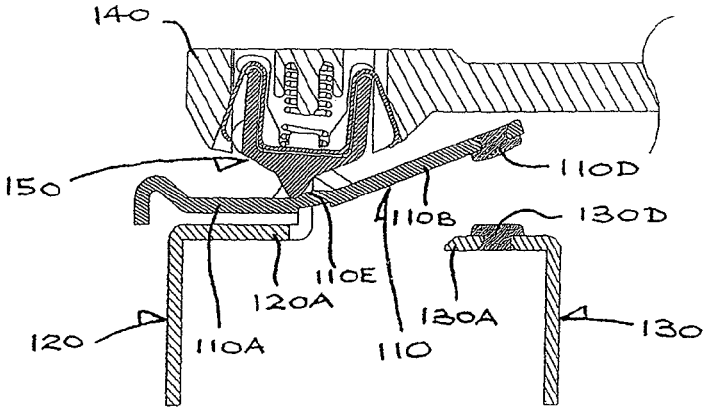
Figure 6:
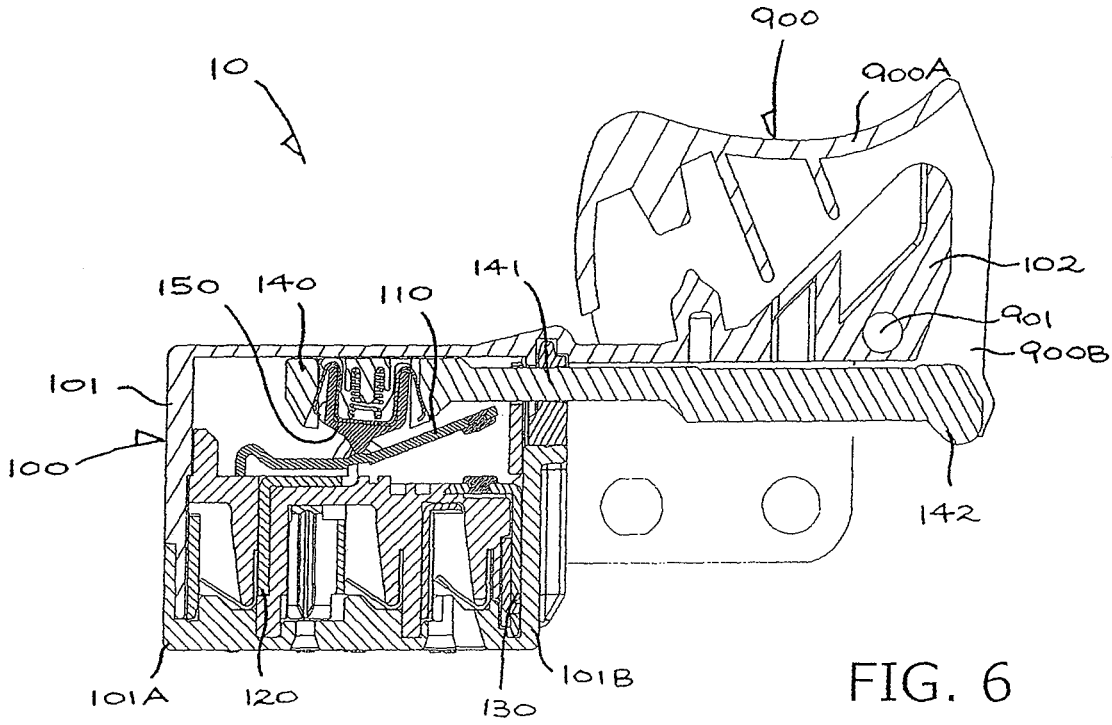
FIGS. 6 and 6A are perspective views corresponding to FIGS. 5 and 5A, showing the electrical switch on the verge of closing.
Figure 6A:
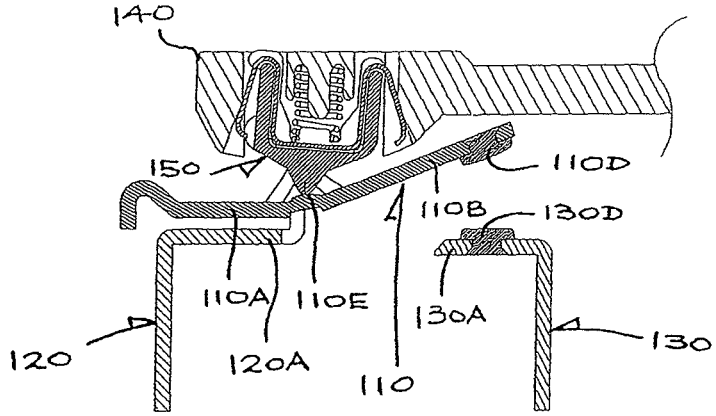
Figure 7:
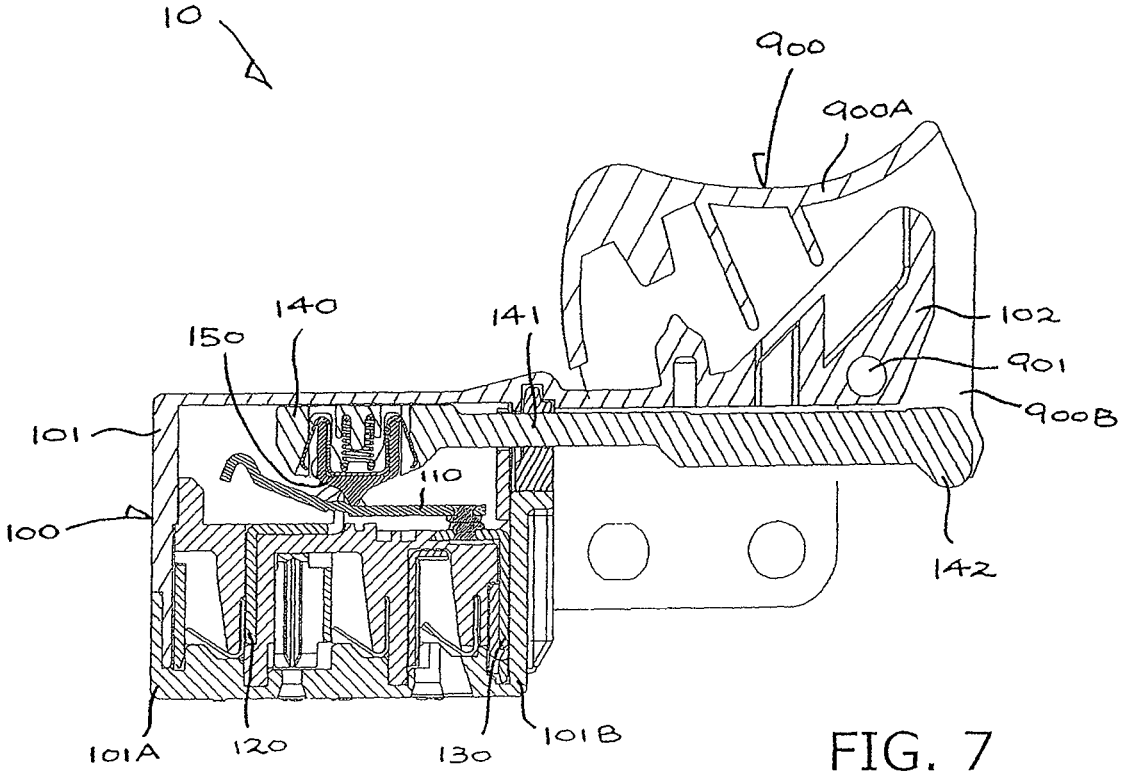
FIGS. 7 and 7A are perspective views corresponding to FIGS. 6 and 6A, showing the electrical switch just closed.
Figure 7A:
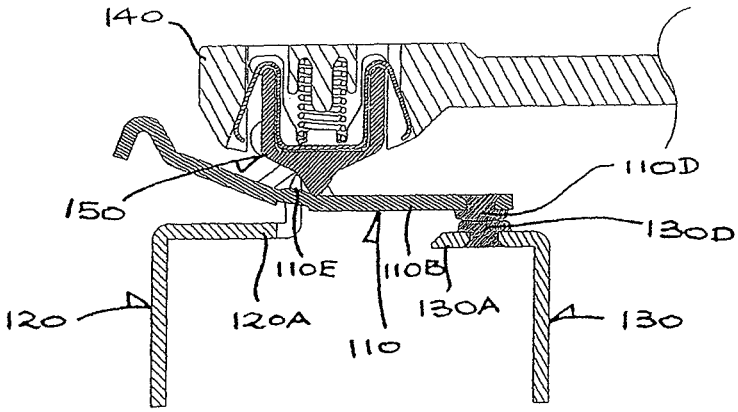
Figure 8:
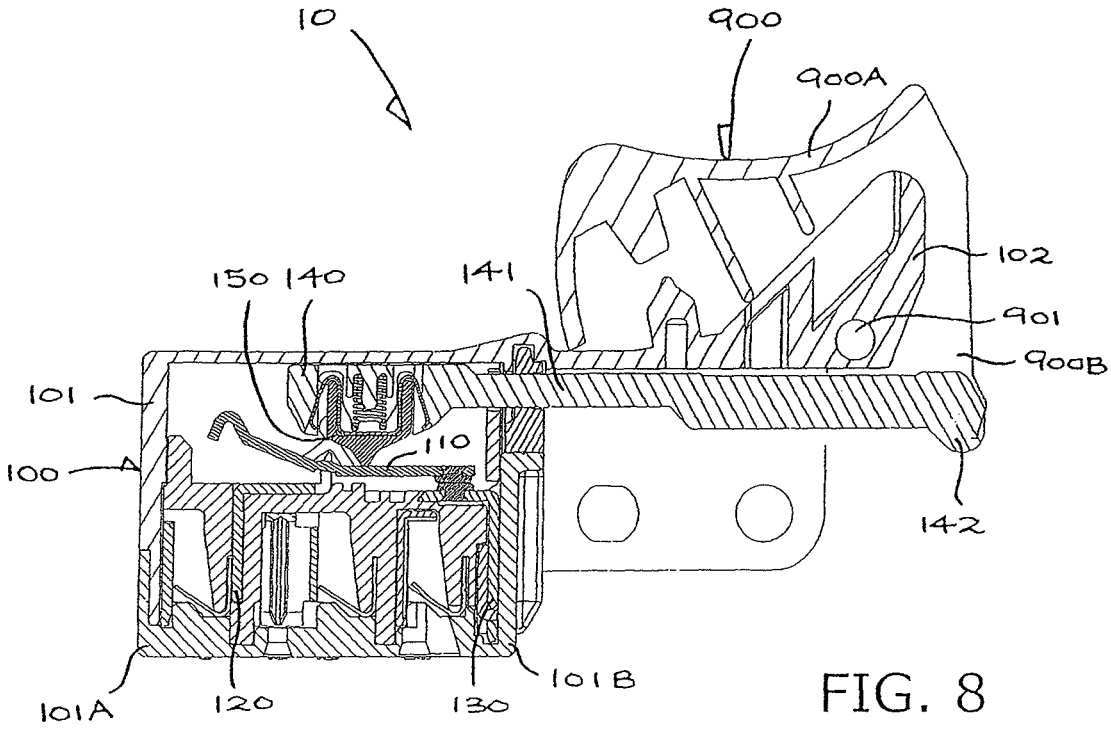
FIGS. 8 and 8A are perspective views corresponding to FIGS. 7 and 7A, showing the electrical switch in an ON position.
Figure 8A:
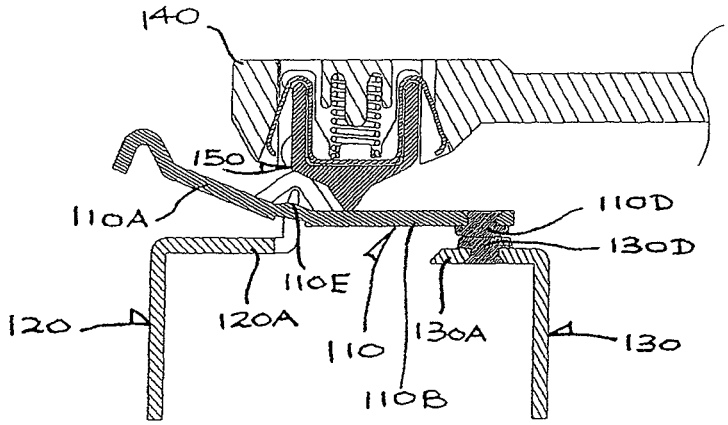

Referring to the drawings, there is shown an electrical switch 10 embodying the invention, which has a base 100 and a trigger 900 pivotable thereon. The base 100 includes a generally rectangular oblong casing 101 shown lying horizontally, which has opposite left and right end portions 101A and 101B. The trigger 900 has an inner part 900B hinged by a hinge pin 901 to a hinge support 102 that protrudes lengthwise from the right casing end portion 101B and includes an outer part 900A for pressing, pushing or pulling by a user.

An internal coil spring 910 compressed between the trigger 900 and the hinge support 102 resiliently biases the trigger 900 outwards about the hinge pin 901. In operation, the trigger 900 may be pressed inwards against the action of the spring 910 and it will, upon release, be flipped by the spring 910 back to its original outer position.

A pair of opposed left and right L-shaped fixed contacts 120 and 130 and a moving contact lever 110 are arranged within the lower interior of the base casing 101. The fixed contacts 120 and 130 are fixed upright within the left and right end portions 101A and 101B of the base casing 101 respectively. Upper end 120A of the left fixed contact 120 turns horizontally inwards and then vertically upwards to form a bifurcate fulcrum 120B, about which the contact lever 110 is pivotably supported. Upper end 130A of the right fixed contact 130 turns horizontally inwards, on which there is riveted a contact stud 130D.

The contact lever 110 has left and right sections 110A and 110B inclined slightly upwards with each other at a small angle. At about mid-length between the left and right sections 110A and 110B, the contact lever 110 includes a pair of downwardly-facing recesses 110C, with which the contact lever 110 bears from above upon the bifurcate fulcrum 120B such that the contact lever 110 is supported for rocking movement in opposite directions about the fulcrum 120B. The two recesses 110C are aligned with each other along a direction at right angles across the length of the contact lever 110, each being formed by deforming a small integral strip portion of the contact lever 110, cut free on opposite sides thereof, off the body of the contact lever 110 into an inverted V-shape.

A contact stud 110D is riveted at the free end of the right section 110B, at a position close to and directly above the fixed contact stud 130D. Upon rocking of the contact lever 110 clockwise, the moving contact stud 110D is pivoted downwards to come into contact with the fixed contact stud 130D, i.e. an ON position. Upon rocking of the contact lever 110 in the anti-clockwise direction, the moving contact stud 110D is pivoted upwards to come out of contact with the fixed contact stud 130D, i.e. an OFF position.

The contact lever 110 includes a small convex bump 110E on the upper surface of the lever 110, at a central position right between the two recesses 110C. The bump 110E is only slightly raised, acting as a barrier between the left and right sections 110A and 110B of the contact lever 110, which can be ridden over.

The electrical switch 10 incorporates an operating mechanism for operating the contact lever 110 by moving the contact lever 110 between the ON and OFF positions. The operating mechanism includes a resiliently biased presser 150 resiliently pressing upon the contact lever 110 for moving the contact lever 110 between the ON and OFF positions while riding in opposite left and right directions past the bump 110E associated with the contact lever 110.

To the resiliently biased presser 150, the bump 110E as a barrier defines a condition/position of maximum strain in the resilient bias upon the presser 150, i.e. a "center" condition, which the presser 150 is arranged to go past, and rapidly past, as it slides along the contact lever 110 from one side of the "center" condition, riding over the bump 110E, to the opposite side, thereby flicking the contact lever 110 to perform a switching action.

The presser 150 is of a U-shape, having a U-shaped cross-section and more specifically a flat rectangular U-shape which is open on opposite sides and has an interior equivalent to an upwardly-facing recess 159. Being of an integral construction, the presser 150 is formed by a pair of opposed left and right vertical limbs 153 and 154, on the presser's left and right sides, interconnected by a horizontally-extending bottom 152 from mid-length of which a beak 151 projects vertically downwardly along a central axis or an axial direction of the presser 150. Under the resilient action of a contact spring 160 and a snap spring 170, the presser 150 bears with its beak 151 downwardly against the upper surface of the contact lever 110.

The uppermost end of the left limb 153 turns slightly to the left, forming a latching hook 155. The right limb 154 is generally flat on its outer side. The recess 159, being delimited by the two limbs 153 and 154 and the bottom 152, is edged by a groove 158 in and extending along the inner surfaces of the left and right limbs 153 and 154 and bottom 152, and in general along the inner surface of the presser 150 and substantially across the presser's opposite left and right sides.

The operating mechanism includes a carrier 140 in engagement with and carrying the presser 150, with the springs 160 and 170 being located and co-acting between the presser 150 and the carrier 140. The carrier 140 is a horizontal elongate structure having a generally flat U-shaped cavity 143 which holds the presser 150, along with the springs 160 and 170, partially inside for limited vertical as well as horizontal sliding movement.

The cavity 143 has upper and lower openings 144 and 145 and includes a pair of opposite left and right side walls having respective inclined lower portions 147A and 147B. The two inclined lower portions 147A and 147B are inclined outwardly, gradually expanding the lower opening 145. Inside the cavity 143, a block 146 divides the upper opening 144 into two left and right small holes 144A and 144B, and there is a knob 148 about half way up the left side wall.

The presser 150 is inserted into the cavity 143 from below via the lower opening 145, with its beak 151 staying outside. The presser 150 is retained inside the cavity 143 as the hook 155 of the former rides over and latches with the knob 148 of the latter. The presser 150 may later be nipped by its beak 151 and pulled back out of the cavity 143, with the hook 155 riding back past the knob 148. Such engagement and disengagement of the hook 155 relative to the knob 148 are possible as a result of the hook 155 being retractable through resilient deflection of the left limb 153 of the presser 150.

The carrier 140 is located slidably within the upper interior of the base casing 101, immediately above the contact lever 110. An integral shaft 141 of the carrier 140 extends horizontally to the right through the wall of the base casing 101 at the right end portion 101B thereof and then reaches immediately underneath the trigger's inner part 900B, on the far side of trigger 900, where a rightmost end 142 of the shaft 141 is hinged to the trigger 900. Upon inward and outward pivotal movement, the trigger 900 slides the carrier 140 back and forth generally in a linear direction along the length of the shaft 141, within the base casing 101 between the casing's left and right end portions 101A and 101B.

The presser 150 extends beyond the carrier 140 in the axial direction and presses downwardly upon the contact lever 110 against the fixed contacts 120 and 130. The presser 150 is received as a loose fit inside the cavity 143 of the carrier 140, being resiliently held in position by the springs 160 and 170. In particular, the carrier 140 holds the presser 150 for or to permit limited sliding movement in the axial direction for contact making and breaking and, additionally, for or to permit a limited extra movement substantially at right angles to the axial direction to perform an improved switching action against contact teasing and/or contact welding at the contact points.

The contact spring 160 is a compression coil spring which extends along the axial direction, centrally in the recess 159 of the presser 150, and is compressed between the block 146 of the carrier 140 and the presser's bottom 152 to resiliently bias the presser 150 outwardly from the carrier 140. The spring 160 serves, while acting upon the presser 150 from right behind and urging it outwardly of the carrier 140, to provide the necessary contact force between the contact pads 110D and 130D of the contact lever 110 and the right fixed contact 130 when the switch 10 is in the ON position.

The snap spring 170 is provided by a spring wire bent into five integral sections, with the $2^{nd}$ to $4^{th}$ sections in a rectangular U-shape forming an intermediate part 172, the $1^{st}$ section forming a left part 173, and the $5^{th}$ section forming a right part 174. The intermediate part 172 has opposite ends, with one end integral with the left part 173 and the other end integral with the right part 174.

The left part 173 is inclined at a relatively small acute angle (i.e. less than 30°) with and on the outer side of the adjacent $2^{nd}$ section, together constituting an elbow spring which acts on the left side of the presser 150. The right part 174 and adjacent $4^{th}$ section together have the same construction but in a mirror image, and provide another elbow spring acting on the right side of the presser 150. In each case, the left or right part 173/174 includes a bend, or at least one bend, about which it exhibits spring action effectively as an elbow spring.

The snap spring 170 has a generally M-shaped configuration whose middle turn (i.e. the intermediate part 172) is of a rectangular U-shape. The intermediate part 172 is fitted and matches within the recess 159, i.e. the inner side or U-shaped cross-section, of the presser 150, with the left and right parts 173 and 174 sticking out at a said acute angle downwardly. The intermediate part 172 is squashed into the recess 159 and holds by itself by virtue of its own resilience as a press-fit in and along the groove 158, extending substantially across the opposite left and right sides of the presser 150.

The presser 150 is inserted from below into the cavity 143 of the carrier 140 and is received therein as a loose fit, with the left and right parts 173 and 174 of the snap spring 170 being compressed to counter-act upon the outwardly-inclined lower portions 147A and 147B of the cavity's left and right side walls and hence maintain the presser 150 in a central neutral position, symmetrically about the central axis. The cavity 143 is wider than the presser 150 such that the presser 150 is movable, generally through pivotal movement, to the left or right to a limited extent against the action of the spring part 173 or 174 ahead i.e. the left or right part 173 or 174 respectively.

By reason of the angle of the two side walls' inclined lower portions 147A and 147B, the left and right parts 173 and 174 of the snap spring 170 also resiliently bias the presser 150 downwardly and outwardly of the cavity 143, with the presser 150 being retained generally inside the cavity 143 by reason of latching of its hook 155 with the knob 148. The presser 150 is therefore also being resiliently biased by the snap spring 170 to press upon the contact lever 110, in addition to the contact spring 160.

In operation, upon being pulled and subsequently released, the trigger 900 pivots and slides the presser 150 back and forth, i.e. to the right and then left, which in turn pivots the contact lever 110 to the ON position and then back to the OFF position.

As the presser 150 slides in a forward direction (to the right or left) while bearing upon the contact lever 110, its beak 151 approaches and reaches the bump 110E in the same direction. Upon its beak 151 hitting the bump 110E, the presser 150 is by reaction pivoted back to a limited extent as extra movement relative to the carrier 140 in the rearward direction against the action of the trailing left part 173 of the snap spring 170.

As a result of such a rearward pivotal movement, the spring part 173 or 174 on the rear or trailing side is instantly compressed, whereby extra forward biasing force is accumulated in the spring part 173 or 174 for subsequently acting upon the presser 150 to assist the presser 150 to move relatively faster as its beak 151 rides past and leaves the bump 110E. The beak 151 is therefore promoted to "snap" past the bump 110E, thereby resulting in a quicker switching action.

Such a quicker or snap switching action is particularly advantageous during a switching action from the ON to the OFF position i.e. a switching OFF action upon release of the trigger 900, in that the contact lever stud 110D will disconnect or depart from the fixed contact stud 130D at a faster speed, whereby the problem relating to contact teasing and/or contact welding at the contact points or studs is minimized and an improved switching action is made possible.

The electrical switch 10 according to the invention is a non-teasable switch especially suitable for controlling the operation of an electrical power tool such as a circular saw, which incorporates an electric motor i.e. an inductive load prone to contact flashover, arcing and welding problems.

In this particular electrical switch 10, there are a pair of the aforesaid carriers 140 (each with presser 150) connected side-by-side to the same shaft 141, each for operating a respective switching mechanism i.e. contact lever 110 and fixed contacts 120 and 130.

It is envisaged that, in a different embodiment, the snap spring 170 may cover the function of the contact spring 160 as it also resiliently biases the presser 150 downwardly against the contact lever 110. In that case, the spring 160 may be dispensed with.

The invention has been given by way of example only, and various other modifications of and/or alterations to the described embodiment may be made by persons skilled in the art without departing from the scope of the invention.

The invention claimed is:

1. An electrical switch comprising:

a body;

at least one fixed contact and a moving contact supported by the body and arranged for movement between a first position, in contact with the at least one fixed contact, and a second position, not in contact with the at least one fixed contact; and an operating mechanism for operating the moving contact by moving the moving contact between the first and second positions, the operating mechanism including a second spring and a resiliently biased presser, resiliently pressed upon the moving contact by the second spring, and moving the moving contact between the first and second positions while riding, in one of opposite first and second directions, past a barrier associated with the moving contact, wherein the presser has opposite first and second sides corresponding to the first and second directions, and the operating mechanism includes a first spring having first and second parts acting on the first and second sides of the presser, respectively, to maintain the presser in a neutral position while permitting movement of the presser in a rearward direction, against urging by the first spring, as the presser reaches the barrier in a forward direction, thereby accumulating an additional forward biasing force in the first spring that is applied to the presser to assist the presser to move faster upon riding past the barrier.

2. The electrical switch as claimed in claim 1, wherein the second spring comprises a compression coil spring acting from behind the presser.

3. The electrical switch as claimed in claim 1, wherein the operating mechanism includes a trigger for manual operation to move the presser and in turn, the moving contact between the first and second positions.

4. The electrical switch as claimed in claim 1, wherein each of the first and second parts includes at least one bend about which one of the first and second parts exhibits spring action.

5. The electrical switch as claimed in claim 4, wherein each of the first and second parts has an elbow configuration.

6. The electrical switch as claimed in claim 1, wherein the first spring comprises a bent wire including at least the first and second parts.

7. The electrical switch as claimed in claim 6, wherein the first spring has a generally M-shaped configuration including a middle turn having a rectangular U-shape.

8. The electrical switch as claimed in claim 1, wherein the presser is resiliently biased by the first spring and presses upon the moving contact.

9. The electrical switch as claimed in claim 8, including a carrier, wherein the presser is held partially within the carrier, the carrier having an outwardly-inclined surface against which the first spring acts to bias the presser to press upon the moving contact.

10. The electrical switch as claimed in claim 1, wherein the operating mechanism includes a carrier in engagement with and carrying the presser, with the first spring located and co-acting between the presser and the carrier.

11. The electrical switch as claimed in claim 10, wherein the carrier and the presser have co-operable latching elements which latch the carrier and the presser together upon engagement of the latching elements.

12. The electrical switch as claimed in claim 10, wherein the presser extends beyond the carrier in an axial direction, pressing upon the moving contact, and the carrier holds the presser for sliding movement in the axial direction and for movement substantially at right angles to the axial direction.

13. The electrical switch as claimed in claim 12, wherein the carrier has a cavity, the presser with the first spring is held partially within the cavity, and the cavity has an opening through which the presser protrudes in the axial direction.

14. The electrical switch as claimed in claim 1, wherein the first and second parts are integral parts of the first spring.

15. The electrical switch as claimed in claim 14, wherein the first spring includes an intermediate part having opposite first and second ends, with the first end integral with the first part and the second end integral with the second part.

16. The electrical switch as claimed in claim 15, wherein the presser has a recess, and the intermediate part is located within the recess.

17. The electrical switch as claimed in claim 15, wherein the presser has a U-shaped cross-section, and the intermediate part is located within the U-shaped cross-section.

18. The electrical switch as claimed in claim 15, wherein the presser has a U-shape having an inner side, and the intermediate part is located within the inner side.

19. The electrical switch as claimed in claim 15, wherein the intermediate part extends substantially across the opposite first and second sides of the presser.

20. The electrical switch as claimed in claim 19, wherein the presser has an inner surface on which the intermediate part extends.

21. The electrical switch as claimed in claim 20, wherein the inner surface of the presser has a groove extending substantially across the opposite first and second sides of the presser, and the intermediate part is located in and along the groove.

* * * * *